US006551199B2

(12) United States Patent
Viera

(10) Patent No.: US 6,551,199 B2
(45) Date of Patent: Apr. 22, 2003

(54) INERTIA CAPSULE FOR GOLF CLUB

(76) Inventor: Anthony A. Viera, 51 Roberts St., Dartmouth, MA (US) 02747

( * ) Notice: Subject to any disclaimer, the term of this patent is extended or adjusted under 35 U.S.C. 154(b) by 0 days.

(21) Appl. No.: 09/945,523

(22) Filed: Sep. 4, 2001

(65) Prior Publication Data

US 2003/0045374 A1 Mar. 6, 2003

(51) Int. Cl.[7] ..... A63B 53/04; A63B 53/08

(52) U.S. Cl. ..... 473/326; 473/333; 473/346; 473/409

(58) Field of Search ..... 473/324, 326, 473/333, 334, 241, 345, 346, 409, 131, 244, 219, 226, 256, 231

(56) References Cited

U.S. PATENT DOCUMENTS 1,561,595 A * 11/1925 Davis
3,037,775 A * 6/1962 Busch
3,589,731 A * 6/1971 Chancellor
3,993,314 A * 11/1976 Harrington
4,655,458 A * 4/1987 Lewandowski
5,176,383 A * 1/1993 Duclos
5,613,916 A * 3/1997 Sommer
5,628,697 A * 5/1997 Gamble
5,776,009 A * 7/1998 McAtee
6,332,849 B1 * 12/2001 Beasley

* cited by examiner

*Primary Examiner*—Sebastiano Passaniti
(74) *Attorney, Agent, or Firm*—Thomas A. Kahrl, ESQ

(57) ABSTRACT

A golf club having an inertia capsule for supporting the strike face of the club, the inertia capsule having a novel air relief channel that is partially filled with mercury and inserted in a hollow club head to transmit ball impact to transition curves cast into the club face uniformly across the club face. A feature of the inertia capsule is that it is configured to be selectively, partially filled with mercury fluid for imparting controlled force against distribution curves cast in the club face. The inertia capsule is supported in the interior chamber by a pair of saddle members.

6 Claims, 4 Drawing Sheets

INERTIA CAPSULE FOR GOLF CLUB

FIELD OF THE INVENTION (TECHNICAL FIELD)

The present invention relates to a golf club having a capsule for supporting the strike face of the club. In particular the invention is directed to an inertia capsule formed by casting in a hollow club head to transmit ball impact uniformly across the club face for providing an enlarged sweet spot.

BACKGROUND PRIOR ART

Golf clubs originally were classified as irons and woods, the irons consisting of metal club heads, and the woods consisting of essentially solid wood club heads. More recently the "wood-type" golf club heads have been replaced by hollow club heads consisting of a fiber reinforced metal matrix typically fabricated of a thin hollow shell to which is attached a club shaft. Such "hollow" clubs have largely replaced the conventional true wood clubs and are used as drivers and fairway "woods". A problem associated with hollow clubs is that the face of a hollow club may be too thin for the impact of an aggressive golfer and may deform upon impact affecting the golf shot, typically with a loss of distance. In the past, attempts have been made to provide for improved golf club heads having high density inserts for achieving greater distance in strokes. Such inserts are disclosed in U.S. Pat. Nos. 5,217,227, 5,143,571, and 5,058,895. These inserts are utilized in the face of a golf club head to improve the club heads moment of inertia and to widen the "sweet spot," and on the backside to improve balance and to shift the center of gravity.

A further example of a golf clubs having improved striking face characteristics, is U.S. PAT. No. 5,890,973 to Gamble which incorporates an insert having a conical head to increase the "sweet spot" of the face of a club and a projection extending rearwardly to the rear of the club. In particular Gamble discloses a club having an insert extending rearwardly from the cap to the rear of the club to reinforce the face of the club and transmit impact forces to the rear of the club.

Accordingly, it is desirable to provide for a new and improved golf club to provide for subject inertia capsule for use with a golf club for imparting a shock wave evenly on the sweet spot of the club which overcomes at least some of the disadvantages of prior art.

SUMMARY OF THE INVENTION

The present invention consists of two aspects: the first is a method of making a composite golf club having an inertia capsule; and the second the composite golf club made by said method.

In the first aspect the method of the present invention comprises a novel combination of the following steps; in a golf club defining a hollow club head formed by a lost wax casting process comprising a hollow club body casting and a separate cover casting, said cover casting having locating tabs to aid in positioning said cover on the body casting for welding at time of assembly. Said hollow body includes two cast-in-place saddles for the purpose of supporting a cast-and-welded tubular cylinder having venturi shaped inner walls, and having inserted a controlled amount of liquid mercury in said capsule. An air relief channel is provided the upper venturi section permitting the within-contained mercury to move from a position at rest to an impact position providing a secondary force against the face of the club at ball contact.

The first saddle is integrally cast into the club face as are transition curves that are employed to distribute sweet spot coverage on the club. A second saddle is cast into the back of the club. Movement of the liquid in the capsule is enhanced during swinging of the club by providing a secondary force against the face of the club.

In the second aspect the composite golf club of the present invention is directed to a golf club head having a front strike face and a back defining a shell defining a hollow interior chamber, the improvement comprising an inertia capsule configured to be selectively partially filled with mercury fluid for imparting controlled force against distribution curves cast in the strike face. The inertia capsule is supported in said interior chamber by a pair of saddle members comprising a front saddle member integrally cast as part of the strike face as are transition curves that are employed to distribute sweet spot coverage on the club. A second, "rear" saddle is cast into the back of the club head. The internal tubular inertia capsule includes a venturishaped wall for controlling the flow of fluid such that the fluid imparts an inertial force against the back of the strike face for transmitting a ball impact at the sweet spot of said face uniformly across the club face.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

It is a general object of the present invention to provide an inertia capsule positioned by cast saddles for use in combination with transition curves cast into the club face that are employed to distribute sweet spot coverage in order to transmit a ball impact at the sweet spot uniformly across the club face.

These and other objects, advantages, and features of the invention will be apparent from the following description of preferred embodiments considered along with the accompanying drawings. The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DESCRIPTION OF THE DRAWINGS

The accompanying drawings, which are incorporated into and form a part of the specification, illustrate several embodiments of the present invention and together with the description serve to explain the principles of the invention. The drawings are only for the purpose of illustrating a preferred embodiment of the invention and are not construed as limiting the invention.

DETAILED DESCRIPTION OF THE PREFERRED EMBODIMENT

Figure 1:
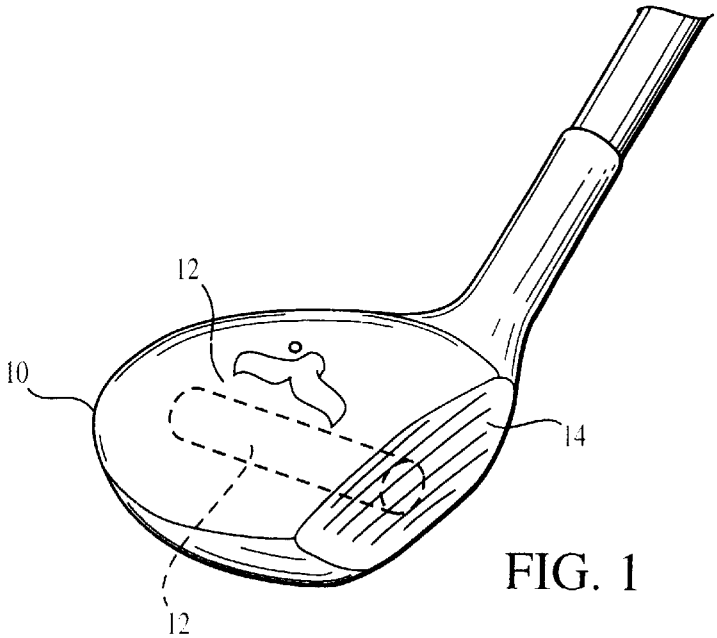
FIG. 1 is a perspective view of the head and a portion of a shaft of a golf club according to the present invention.
Figure 2:
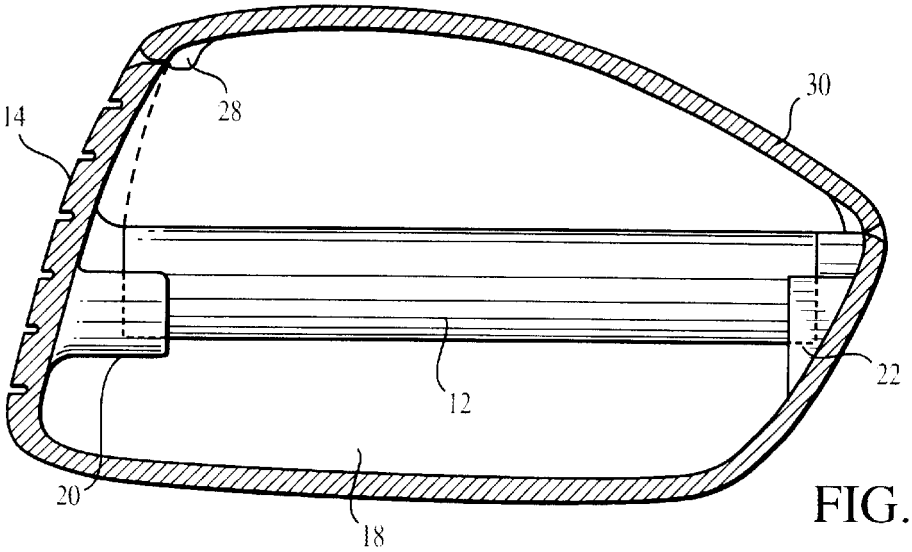
FIG. 2 is a cross sectional view taken along line 2—2 of FIG. 1.

Referring to the FIGS. 1–5, the preferred embodiment is directed to the inventive combination of a golf club head 10 and an inertia capsule 12 for striking a golf ball, not shown, on a strike face 14. Referring to FIG. 2 there is shown is a cross sectional view taken along line 2—2 of the golf club head 10 comprising a shell 16 defining a hollow interior chamber 18 having a front saddle member 20 and a rear saddle member 22. Golf club head 10 comprises a hollow club body casting and a separate cover casting 30, said cover casting having locating tabs 28 to aid in positioning said cover on the body casting for welding at time of assembly. Said hollow body includes two cast-in-place saddles 20 & 22 for the purpose of supporting a cast-and-welded tubular cylinder of inertia capsule 12 having venturi shaped inner walls 44, and having inserted a controlled amount of liquid mercury 32 in said capsule.

Figure 3:
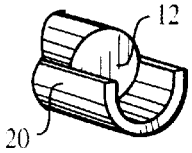
FIG. 3 is a fragmentary view of a front saddle of FIG. 2.
Figure 4:
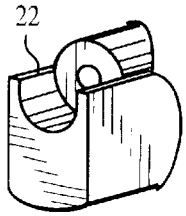
FIG. 4 is a fragmentary view of a rear saddle of FIG. 2.
Figure 5:
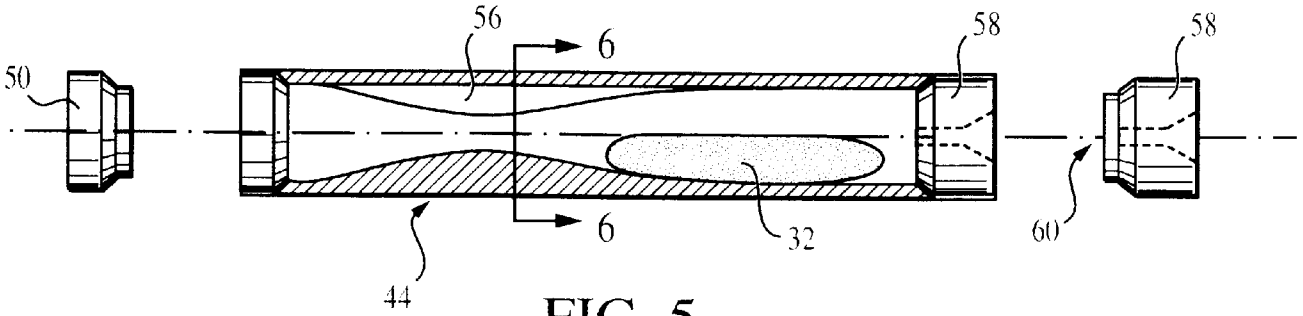
FIG. 5 is a cross-sectional view of the volume of the fluid containing the venturi chamber showing a front plug and a rear plug.

There is also shown on shell 16, front strike face 14 for striking a golf ball and back 26 of said golf club head 10. Included in golf club head 10 and disposed within hollow interior chamber 18, is inertia capsule 12 configured to be selectively partially filled with mercury fluid 32 for imparting controlled force, see FIG. 11, against transition curves 34 cast in strike face 14. The inertia capsule 12 is supported in said hollow interior chamber 18 by a pair of saddle members comprising the front saddle member 20 integrally cast as part of the strike face 14 as are transition curves 34 that are employed to distribute sweet spot coverage on the golf club head 10. The second, "rear" saddle 22 is cast into the back 26 of said club head. The inertia capsule 12 is weighted, is of tubular shape, as is shown in FIG. 5, and includes a venturi shaped wall 44. As is shown in FIG. 1 inertia capsule 12 is disposed between said strike face 14 and back 26 in generally orthogonal relationship with said face;

Referring to FIGS. 3 and 4 there is shown an enlarged view of the front saddle member 20 cast behind the strike face 14 and an enlarged view of the rear saddle member 22 cast into the back 26.

Figure 7:
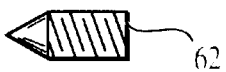
FIG. 7 is a fragmentary view of a filling plug of FIG. 5.
Figure 6:
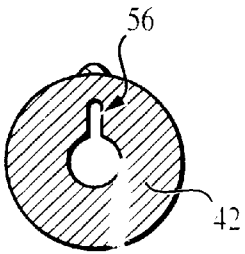
FIG. 6 is a section along A—A of FIG. 5
Figure 8:
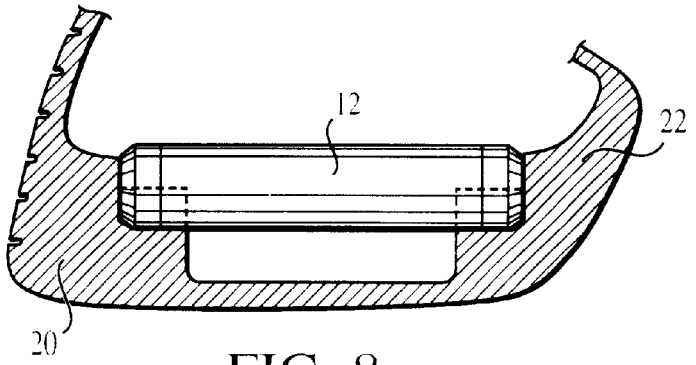
FIG. 8 is a cross sectional view of an alternate embodiment of FIG. 1.
Figure 9:
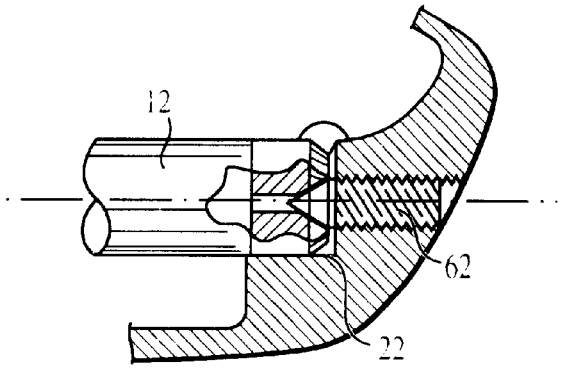
FIG. 9 is a fragmentary view of an alternate embodiment of filling plug of FIG. 5.

As is shown in FIGS. 5, 6 & 7, inertia capsule 12 defines a front plug 50 defining a pilot hole 52, a cast venturi capsule wall member 44 having a relief slot 56, a rear plug 58 including a clearance hole 60 associated with a filling syringe 61 and set screw 62 for sealing said rear plug after liquid filling.

Figure 10:
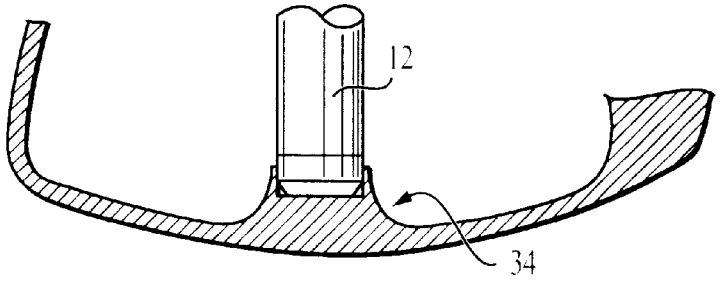
FIG. 10 is a fragmentary view of the inertia capsule contacting the strike face.

As is shown in FIG. 10 said integrally cast front saddle 20 is associated with a variable curved transition curve 34 for spreading out impact shock evenly on said sweet spot.

Figure 11:
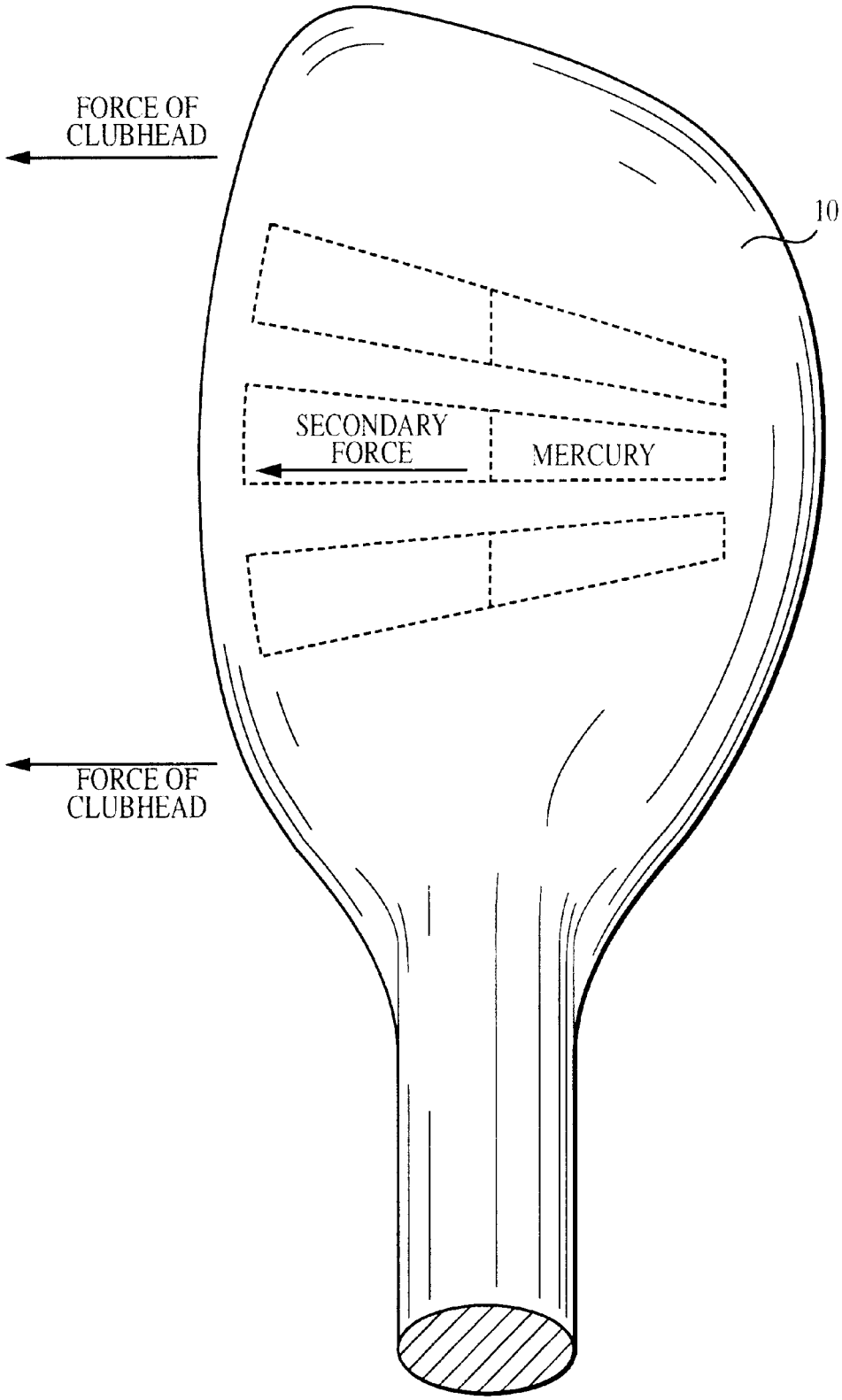
FIG. 11 is a plan view of FIG. 1 showing force lines.

In FIG. 11 there is shown a plan view of golf club head 10 showing the force direction of said clubhead as well as the secondary force lines of the liquid mercury 32.

What is claimed is:

1. A golf club head in combination with a club shaft comprising;

a shell defining a hollow interior chamber, a front strike face for striking a golf ball and a back, the hollow chamber defining a front saddle member connected to the front strike face, a rear saddle member connected to the back, a weighted inertia capsule disposed between said front saddle and said rear saddle member arranged in orthogonal relationship with said face wherein said inertia capsule is of tubular shape and defines a venturi shaped wall enclosing a shaped venturi space, fluid filling means for partially filling said venturi space and partially filled with fluid;

wherein said fluid imparts a dynamic internal force toward the strike face;

wherein said weighted inertia capsule imparts an internal force toward the strike face;

wherein said capsule makes contact against a transition curve to transmit ball impact uniformly across the club face; and wherein the sweet spot of said club head defined as a ball contact area is enlarged to the area defined by the transition curve.

2. The golf club head of claim 1 wherein said inertia capsule defines a front plug defining a pilot hole, a cast venturi capsule wall member having a relief slot, a rear plug including a clearance hole associated with a filling syringe and a set screw for sealing said rear plug after liquid filling.

3. The golf club head of claim 2 wherein said fluid filling means comprises a syringe for partially filling the cast venturi shaped inertia capsule with mercury via the rear plug clearance hole.

4. The golf club head of claim 3 wherein said fluid filling means comprises liquid mercury.

5. A golf club head for striking a golf ball, the head comprising a strike face, a shell defining a hollow interior chamber having a front saddle member and a rear saddle member and a tubular venturi inertia capsule having fluid disposed in orthogonal relationship with said face such that the capsule makes contact against distribution curves cast in the strike face for transmitting ball impact at the sweet spot of said face uniformly across the club face.

6. A method of making a golf club head having a striking face for striking a golf ball, said method comprising the steps of;

forming a golf club head defining a hollow club head body by a lost wax casting process, said casting including integrally formed front and rear saddles:

providing a separate cover formed by casting, said cover having positioned tabs to aid in welding during final assembly between the club head body and the cover;

positioning a cast inertial capsule of tubular shape having venturi-shaped inner walls on the front and rear saddles within the hollow club head body;

providing an air relief channel in the venturi-shaped inner walls;

inserting a controlled amount of liquid mercury within, said capsule;

said air relief channel permitting the liquid mercury to move from a position at rest to an impact position for providing a secondary force against the striking face of the club head.

* * * * *